US005958520A

United States Patent [19]

Cook et al.

[11] Patent Number: 5,958,520

[45] Date of Patent: Sep. 28, 1999

[54] METHOD OF STAGGERING REVERSAL OF THERMAL SPRAY INSIDE A CYLINDER BORE

[75] Inventors: David James Cook, Farmington Hills; James Richard Baughman, Plymouth, both of Mich.

[73] Assignee: Ford Global Technologies, Inc., Dearborn, Mich.

[21] Appl. No.: 09/114,120

[22] Filed: Jul. 13, 1998

[51] Int. Cl.[6] ..... C23C 4/16

[52] U.S. Cl. ..... 427/446; 427/449; 427/456; 427/233; 427/236; 29/888.061

[58] Field of Search ..... 427/233, 236, 427/446, 456, 449; 29/888.061

[56] References Cited

U.S. PATENT DOCUMENTS

| | | | |
|---|---|---|---|
| 2,588,422 | 3/1952 | Shepard | 427/236 |
| 5,185,183 | 2/1993 | Gonda et al. | 427/236 |
| 5,271,967 | 12/1993 | Kramer et al. | 427/455 |
| 5,380,564 | 1/1995 | VanKuiken, Jr. et al. | 427/456 |
| 5,622,753 | 4/1997 | Shepley et al. | 427/453 |
| 5,707,693 | 1/1998 | Vliet et al. | 427/449 |
| 5,714,205 | 2/1998 | Marantz et al. | 427/449 |

*Primary Examiner*—Katherine A. Bareford
*Attorney, Agent, or Firm*—Lorraine S. Melotik

[57] ABSTRACT

A method of staggering reversal of thermal spray inside a cylinder bore of an internal combustion engine. The method includes the steps of thermally spraying a surface of the cylinder bore by moving a thermal spray gun along a length of the surface. The method also includes the steps of reversing a direction of travel of the thermal spray gun inside the cylinder bore at different points along the length of the surface to provide a multi-layered coating on the surface.

18 Claims, 3 Drawing Sheets

METHOD OF STAGGERING REVERSAL OF THERMAL SPRAY INSIDE A CYLINDER BORE

BACKGROUND OF THE INVENTION

1. Field of the Invention

The present invention relates generally to thermal spraying internal combustion engines and, more specifically, to a method of staggering reversal of thermal spray inside a cylinder bore of an internal combustion engine.

2. Description of the Related Art

It is known to coat a surface of a cylinder bore for an internal combustion engine. Typically, thermal spray guns are conventionally supported and moved at a uniform speed to coat the surface. The thermal spray guns deposit a layer of sprayed material in a relatively thin coat to avoid concentrating undue heat in the surface. To build a greater thickness of the sprayed material, several passes of the thermal spray gun are necessary. If the thermal spray gun is immediately reversed in its uniform linear travel precisely at the end of the surface, a non-uniform bulge may occur in the coating at such reversal edge. Excess material is laid down at such reversal edge by the slowing down of the gun to make the reversal. This bulge is disadvantageous because (i) it introduces greater heat to the coating at such bulge, leading to possible "hot spots" or residual thermal stress, (ii) the bulging can possibly lead to disbanding as a result of an excessive shrinkage rate in the coating when the thermal spray gun moves away.

In an attempt to overcome this problem, the travel of the thermal spray gun is extended well beyond the surface for the coating (i.e., overspraying), before reversing the travel of the thermal spray gun. This results in considerable waste of spray material.

When spraying the internal combustion engine that cannot tolerate the presence of a coating outside the surface of the cylinder bore, one must, either (i) use expensive masking to prevent contaminating such other parts of the internal combustion engine that are not to be coated, (ii) use a release agent as well as tedious cleaning of the adjacent surfaces to remove the unwanted coating (cleaning is essential to remove the risk of loose particles adjacent and outside the edge of the cylinder bore, which particles may break loose and contaminate other moving parts of the internal combustion engine). Therefore, there is a need in the art to contain and reduce overspray when spraying a cylinder bore of an internal combustion engine.

SUMMARY OF THE INVENTION

Accordingly, the present invention is a method of staggering reversal of thermal spray inside a cylinder bore of an internal combustion engine. The method includes the steps of thermally spraying a surface of the cylinder bore by moving a thermal spray gun along a length of the surface and reversing a direction of travel of the thermal spray gun inside the cylinder bore at different points along the length of the surface to provide a multi-layered coating on the surface.

One advantage of the present invention is that a method is provided of staggering the reversal of thermal spray inside a cylinder bore of an internal combustion engine. Another advantage of the present invention is that the method varies the reversal point of the thermal spray gun on each pass during spraying of the cylinder bore. Yet another advantage of the present invention is that the method prevents the creation of a large build up or "hot spot". Still another advantage of the present invention is that the method enables reversal of the thermal spray gun within the cylinder bore to reduce masking requirements and improve spray material target efficiency. A further advantage of the present invention is that the method significantly reduces overspray of the spray material. Yet a further advantage of the present invention is that the changing of only the reversal points ensures a very consistent microstructure of the sprayed material throughout the cylinder bore.

Other features and advantages of the present invention will be readily appreciated as the same becomes better understood after reading the subsequent description taken in conjunction with the accompanying drawings.

DESCRIPTION OF THE PREFERRED EMBODIMENT(S)

Figure 1:
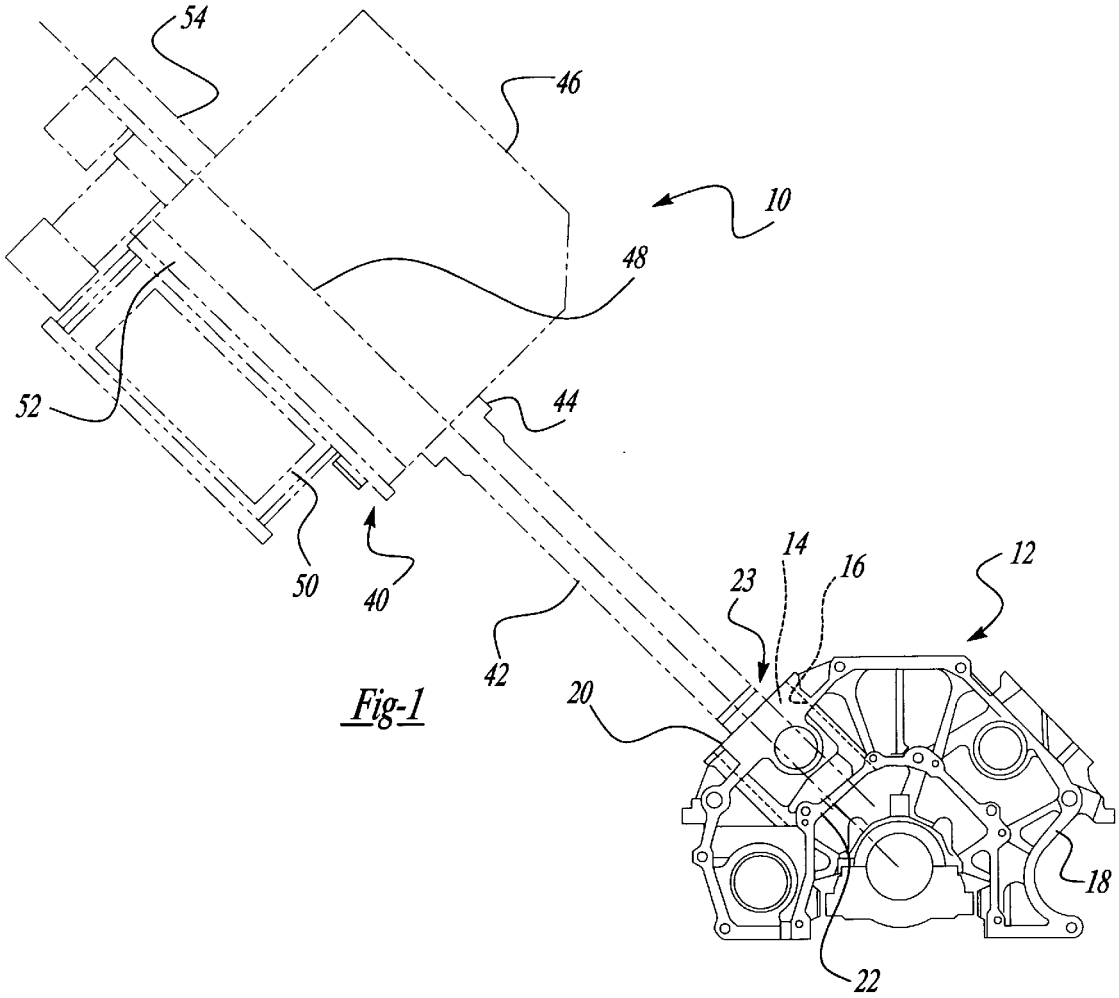
FIG. 1 is an elevational view of a thermal spray gun used to carry out a method, according to the present invention, of staggering reversal of thermal spray in a cylinder bore of an internal combustion engine.
Figure 2:
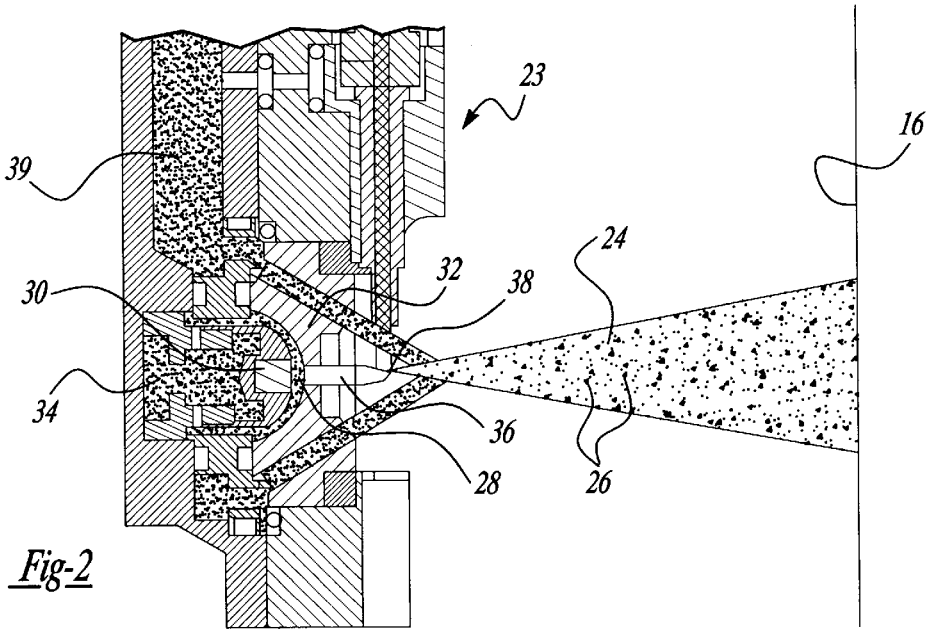
FIG. 2 is an enlarged fragmentary view of a portion of the thermal spray gun of FIG. 1 illustrating how the thermal spray is created.

Referring to the drawings and in particular FIGS. 1 and 2, one embodiment of a thermal spray gun 10, used to carry out a method according to the present invention, is shown in operational relationship with an internal combustion engine, generally indicated at 12. The internal combustion engine 12 has at least one, preferably a plurality of cylinder bores 14 formed by interior surfaces or walls 16 of an engine block 18. The cylinder bore 14 has a top edge 20 of the interior surface 16 and a bottom edge 22 of the interior surface 16. It should be appreciated that the internal combustion engine 12 is conventional and known in the art.

The thermal spray gun 10 is an electric wire arc spray gun, preferably of the type described in U.S. patent application Ser. No. 08/799,242, filed Feb. 14, 1997, now U.S. Pat. No. 5,808,270, and commonly owned by the assignee of the present invention. The thermal spray gun 10 has a gun head, generally indicated at 23, creating a spray 24 of molten metal droplets 26 by first establishing an arc 28 between a cathodic electrode 30 and an anodic nozzle 32. The electrodes 30 and 32 are supplied with D.C. electrical power at a current within a range of approximately 20–200 amps and a voltage in a range of approximately 80–320 volts. A plasma creating gas 34 (such as air, nitrogen or argon) possibly mixed with some hydrogen or helium at a pressure of about 20–150 psig, is directed through the arc 28 to be instantaneously heated to a temperature that creates a stream of hot ionized electrically conductive gas, plasma 36. To extend the plasma plume, the arc 28 is transferred from the electrode 30 past the nozzle 32 to a continuously fed wire tip 38. Secondary gas 39, preferably air, at a pressure of approximately 50–120 psi is funneled around the plasma plume to coverage and intersect the spray 24 to accelerate, atomize and shroud the metal droplets 26.

Figure 3:
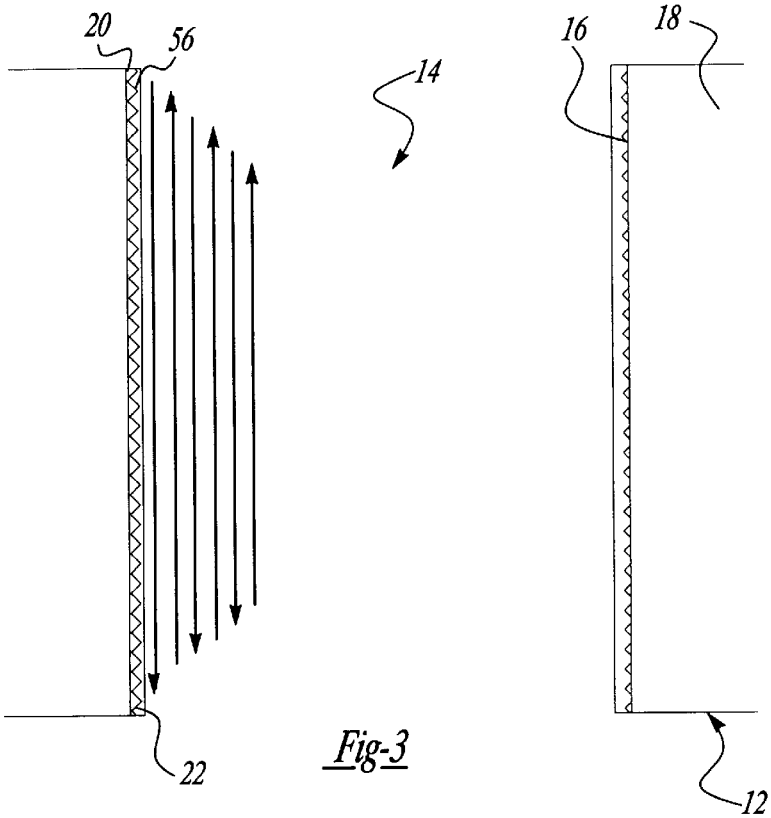
FIG. 3 is a diagrammatic view illustrating the staggering reversal of the thermal spray for the thermal spray gun inside the cylinder bore of the internal combustion engine.

The thermal spray gun 10 includes a mechanism, generally indicated at 40, for supporting and moving the gun head 23 for coating the interior surfaces 16 of cylinder bores 14 of the internal combustion engine 12. The mechanism 20 includes a spindle 42 supporting the gun head 23 at one end and which spindle contains channels (not shown) for respectively supplying wire, plasma gas and secondary gas to the gun head 23. The spindle 42 is supported at its opposite end 44 by a rotary drive 46 to rotate the spindle 42 either about its own axis 48 or an axis parallel thereto. The rotary drive 46 is, in turn, supported on a linear traverse mechanism or slide 50 that moves the rotary drive 46 up and down a track 52 by action of a ball-screw type mechanical drive 54 (such latter drive converting rotary action of an electric motor to linear motion by intermeshing worm gears). Thus, the spray head 23 (while rotating) is moved up and down within the cylinder bore 14, reversing its linear direction, thereby building up a multi-layered coating 56 (FIG. 3). It should be appreciated that the thermal spray gun 10 is conventional and known in the art.

A method, according to the present invention, is disclosed of staggering reversal of thermal spray inside the cylinder bore 14 of the internal combustion engine 12. The method generally includes the steps of thermally spraying the interior surface 16 of the cylinder bore 14 by moving the gun head 23 of the thermal spray gun 10 along a length of the interior surface 16 and reversing a direction of travel of the gun head 23 of the thermal spray gun 10 inside the cylinder bore 14 at different points along the length of the interior surface 16 to provide a multi-layered coating 56 on the interior surface 16 as illustrated in FIG. 3.

More specifically, the method optimally includes the step of thermally spraying a bond coat material from the top edge 18 to the bottom edge 20 of the interior surface 16 on a first pass of the gun head 23 of the thermal spray gun 10 entering the cylinder bore 14 of the internal combustion engine 12. The bond coat material is a nickel and aluminum alloy applied in a thickness of approximately 0.002 inches. It should be appreciated that the bond coat material is conventional and known in the art. It should also be appreciated that, before the bond coat material is applied, the interior surface 16 is cleaned by Producto Chemical 5896 and preferably fluxed by wet or dry techniques to strip the interior surface 16 free of oxides to promote metallurgical as well as mechanical bonding.

Once the bond coat material has been applied, the method includes the steps of thermal spraying a top coat material over the bond coat material on the interior surface 16 in a plurality of passes of the gun head 23 of the thermal spray gun 10 within the cylinder bore 14 of the internal combustion engine 12. The top coat material is a 1010 steel material applied in a thickness of approximately 0.001 inches/per pass for a total of 0.014 inches. It should be appreciated that the top coat material is conventional and known in the art.

After the first pass of the bond coat material, the method includes the step of reversing a direction of travel of the gun head 23 of the thermal spray gun 10 at the bottom edge 20 of the interior surface 16 and moving the gun head 23 of the thermal spray gun 10 along the interior surface 16. The gun head 23 of the thermal spray gun 10 reverses direction at the top edge 20 and bottom edge 22 on the first and second pass. The gun head 23 of the thermal spray gun 10 reverses direction at different points along the surface 16 for passes three (3) through fifteen (15) in a staggered manner as illustrated by the arrow in FIG. 3. The gun head 23 relative to the top edge 20 and bottom edge 22 has reversal points according to Table 1 as follows:

TABLE 1

| Pass | Bottom (inches) | Top (inches) |
|---|---|---|
| Pass 1, 2 | 0 | 0 |
| Pass 3, 4 | 0 | −0.05 |
| Pass 5, 6 | −0.100 | −0.1 |
| Pass 7, 8 | −0.200 | −0.15 |
| Pass 9, 10 | −0.300 | −0.2 |
| Pass 11, 12 | −0.400 | −0.25 |
| Pass 13, 14 | −0.500 | 0 |
| Pass 15 | 0 | |

After the fifteenth pass, the gun head 23 of the thermal spray gun 10 exits the cylinder bore 14. It should be appreciated that the gun head 23 not only moves up and down along the length of the cylinder bore 14 but the gun head 23 also rotates about an axis coincident or parallel to an axis of the cylinder bore 14 to form a uniformly thick coating or sleeve 56 deposited on the interior surface 16 of the cylinder bore 14. It should also be appreciated that the reversal points are programmed into a controller (not shown) for the thermal spray gun 10 and that a position sensor (not shown) is used in conjunction with controller to sense the position of the gun head 23 within the cylinder bore 14 to cause the drive 54 to reverse.

Figure 4:
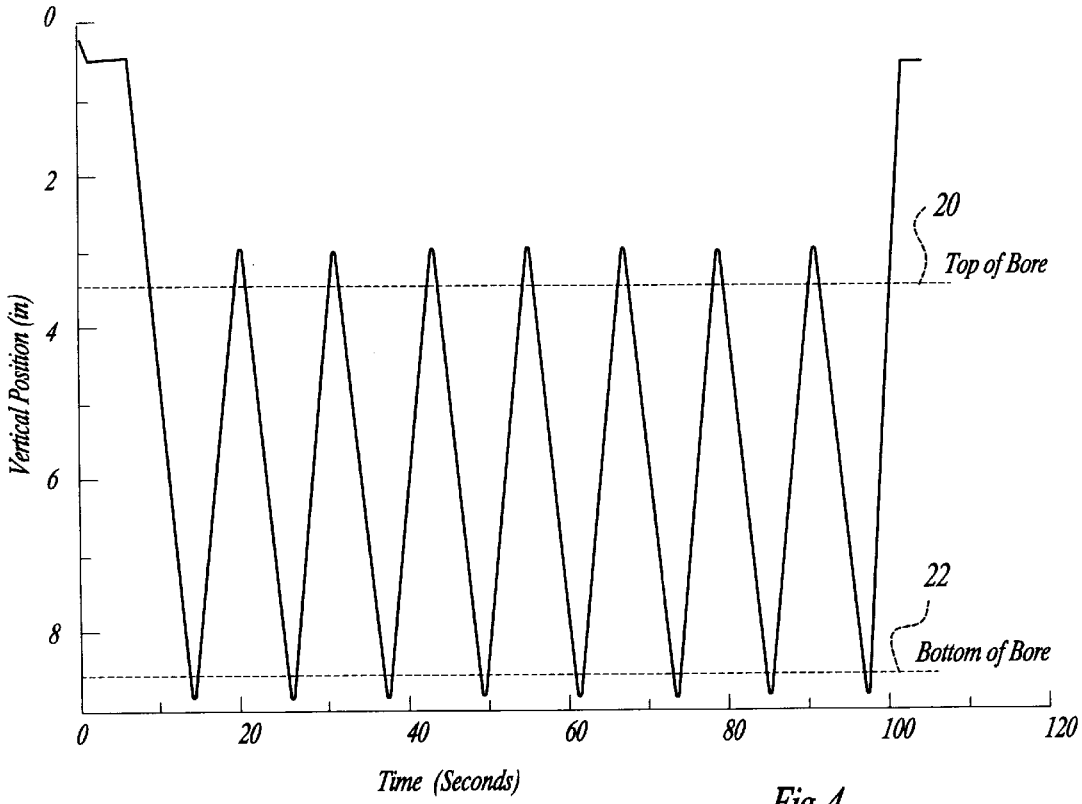
FIG. 4 is a graph of vertical position versus time of standard thermal spray of a cylinder bore of an internal combustion engine.

Referring to FIG. 4, a graph of vertical position of the gun head 23 of the thermal spray gun 10 versus time is shown for the standard process. As illustrated, the gun head 23 reverses direction outside or beyond the top edge 20 and bottom edge 22 in an overspray manner.

Figure 5:
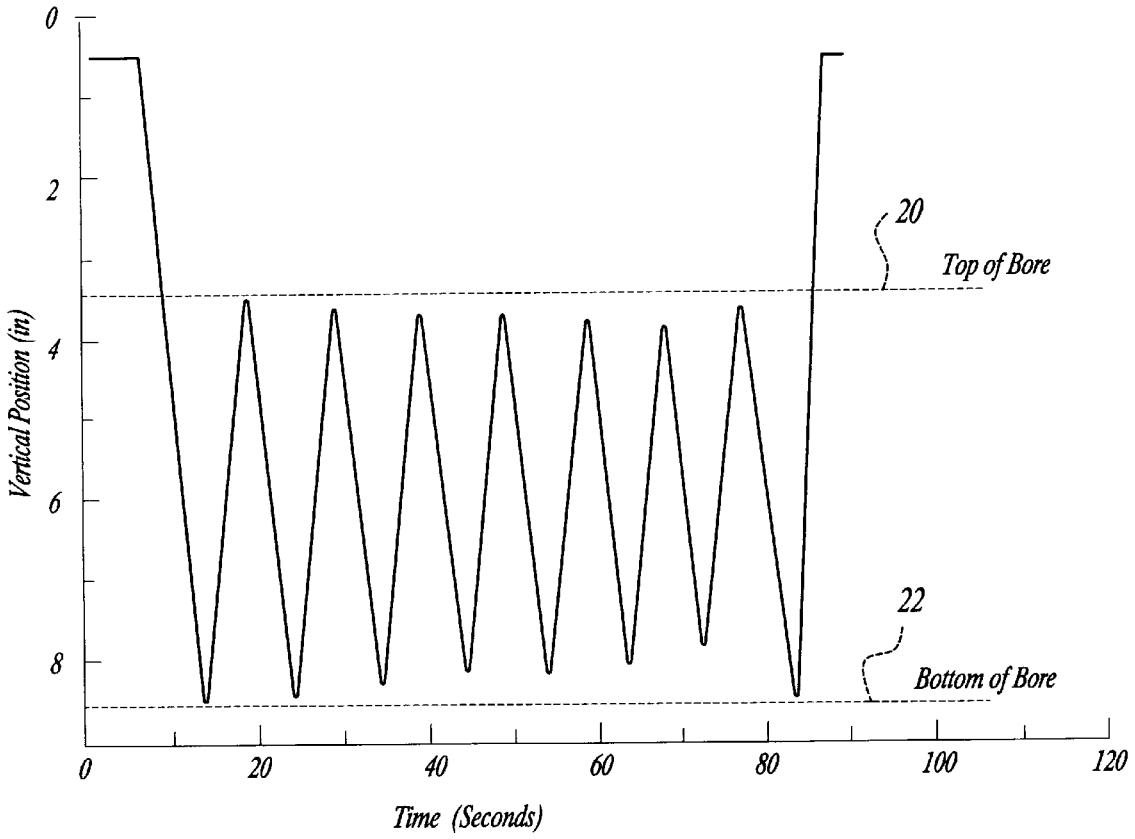
FIG. 5 is a graph of vertical position versus time of staggered reversal of thermal spray of a cylinder bore of an internal combustion engine according to the present invention.

Referring to FIG. 5, a graph of vertical position of the gun head 23 of the thermal spray gun 10 versus time is shown for the staggered reversal method according to the present invention. As illustrated, the gun head 23 reverses direction inside of the top edge 20 and bottom edge 22 of the cylinder bore 14 in a staggered manner. As a result, the time for the gun head 23 to travel is less than the standard process and overspray is reduced by almost eighty percent (80%).

Accordingly, the method allows for significant reduction in overspray by allowing the travel of the gun head 23 of the thermal spray gun 10 to be reversed inside of the cylinder bore 14. The method reverses the travel at a different position depending on which pass is being applied to allow a very uniform coating 56 to be deposited with excellent adhesion at the edges 20,22 of the cylinder bore 14. The method also reduces cycle time by reducing the length of travel of the gun head 23 of the thermal spray gun 10.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A method of staggering reversal of thermal spray inside a cylinder bore of an internal combustion engine comprising the steps of:

thermally spraying a surface of the cylinder bore by moving a thermal spray gun along a length of the surface in three or more passes; and reversing a direction of travel of the thermal spray gun for each pass inside the cylinder bore at different points along the length of the surface to provide a multi-layered coating on the surface.

2. A method as set forth in claim 1 wherein said step of thermally spraying comprises thermally spraying a bond coat material from a top edge of the surface to a bottom edge of the surface on a first pass.

3. A method as set forth in claim 2 wherein said bond coat material has a thickness of approximately 0.002 inches.

4. A method as set forth in claim 2 wherein said step of thermally spraying comprises thermally spraying a top coat material over the bond coat material on the surface in a plurality of passes.

5. A method as set forth in claim 4 wherein said top coat material has a thickness of approximately 0.001 inches/per pass.

6. A method as set forth in claim 4 wherein the plurality of passes comprises fifteen.

7. A method as set forth in claim 6 wherein said step of reversing comprises reversing direction of the thermal spray gun at a top edge and a bottom edge of the surface for a first pass and second pass.

8. A method as set forth in claim 7 wherein said step of reversing comprises reversing direction of the thermal spray gun at different points along the surface between the top edge and the bottom edge for passes three through fifteen in a staggered manner.

9. A method as set forth in claim 8 wherein said step of reversing comprises reversing direction of the thermal spray gun at a bottom edge of the surface for a last pass.

10. A method of staggering reversal of thermal spray inside a cylinder bore of an internal combustion engine comprising the steps of:

thermally spraying a surface of the cylinder bore from a top edge thereof to a bottom edge thereof by moving a thermal spray gun along a length of the surface in three or more passes; and reversing a direction of travel of the thermal spray gun for each pass inside the cylinder bore at different points along the length of the surface to provide a multi-layered coating on the surface.

11. A method as set forth in claim 10 wherein said step of thermally spraying comprises thermally spraying a bond coat material on a first pass.

12. A method as set forth in claim 11 wherein said bond coat material has a thickness of approximately 0.002 inches.

13. A method as set forth in claim 11 wherein said step of thermally spraying comprises thermally spraying a top coat material over the bond coat material for the plurality of passes.

14. A method as set forth in claim 13 wherein said top coat material has a thickness of approximately 0.001 inches/per pass.

15. A method as set forth in claim 13 wherein the plurality of passes comprises fifteen.

16. A method as set forth in claim 15 wherein said step of reversing comprises reversing direction of the thermal spray gun at the top edge and the bottom edge for a first pass and second pass.

17. A method as set forth in claim 16 wherein said step of reversing comprises reversing direction of the thermal spray gun at different points between the top edge and the bottom edge for passes three through fifteen in a staggered manner.

18. A method as set forth in claim 17 wherein said step of reversing comprises reversing direction of the thermal spray gun at the bottom edge for a last pass.

* * * * *